US008836247B2

(12) United States Patent
Yamamoto et al.

(10) Patent No.: US 8,836,247 B2
(45) Date of Patent: Sep. 16, 2014

(54) DRIFT-TUBE LINEAR ACCELERATOR

(75) Inventors: Kazuo Yamamoto, Chiyoda-ku (JP); Hirofumi Tanaka, Chiyoda-ku (JP); Hiromitsu Inoue, Chiyoda-ku (JP); Sadahiro Kawasaki, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 210 days.

(21) Appl. No.: 13/643,225

(22) PCT Filed: Jun. 14, 2011

(86) PCT No.: PCT/JP2011/063591
§ 371 (c)(1),
(2), (4) Date: Oct. 24, 2012

(87) PCT Pub. No.: WO2012/008255
PCT Pub. Date: Jan. 19, 2012

(65) Prior Publication Data

US 2013/0038248 A1 Feb. 14, 2013

(30) Foreign Application Priority Data

Jul. 12, 2010 (JP) ..... 2010-157738

(51) Int. Cl.
*H01J 25/00* (2006.01)
*H05H 9/04* (2006.01)
*H05H 7/22* (2006.01)
*H05H 7/04* (2006.01)

(52) U.S. Cl.
CPC ..... *H05H 9/042* (2013.01); *H05H 2007/222* (2013.01); *H05H 2007/043* (2013.01)
USPC ..... 315/500; 315/501; 315/506; 315/507

(58) Field of Classification Search
USPC ..... 315/500, 501, 505, 506, 507, 111.41, 315/111.61, 111.81, 111.21
See application file for complete search history.

(56) References Cited

U.S. PATENT DOCUMENTS 6,744,226 B2 * 6/2004 Yu et al. ..... 315/505
7,609,009 B2 10/2009 Tanaka et al.

(Continued)

FOREIGN PATENT DOCUMENTS

JP 5-283025 A 10/1993
JP 11-329795 A 11/1999

(Continued)

OTHER PUBLICATIONS

Office Action issued on Jan. 7, 2014, by the Japanese Patent Office in corresponding Japanese Patent Application No. 2012-524499, and an English Translation of the Office Action. (7 pages).
International Search Report (PCT/ISA/210) issued on Sep. 6, 2011, by the Japanese Patent Office as the International Searching Authority for International Application No. PCT/JP2011/063591.

(Continued)

*Primary Examiner* — Douglas W Owens
*Assistant Examiner* — Jianzi Chen
(74) *Attorney, Agent, or Firm* — Buchanan Ingersoll & Rooney PC

(57) ABSTRACT

A drift-tube linear accelerator that passes an injected particle beam through inside a plurality of cylindrical drift-tube electrodes arranged in a cylindrical cavity in a particle beam traveling direction and accelerates the particle beam by a radio-frequency electric field generated between the plurality of cylindrical drift-tube electrodes, wherein at least part of a focusing device for focusing the particle beam is disposed inside an end drift-tube electrode that is arranged nearest the injection side of the cylindrical cavity among the plurality of cylindrical drift-tube electrodes, with the focusing device being positionally adjustable independently of the end drift-tube electrode.

5 Claims, 7 Drawing Sheets

(56) References Cited

U.S. PATENT DOCUMENTS

| | | | | |
|---|---|---|---|---|
| 2010/0301782 | A1 | 12/2010 | Yamamoto et al. | |
| 2011/0216886 | A1 * | 9/2011 | Ho et al. | 378/137 |

FOREIGN PATENT DOCUMENTS

| | | | |
|---|---|---|---|
| JP | 2000-243599 | A | 9/2000 |
| JP | 2008-166093 | A | 7/2006 |
| JP | 2006-351233 | A | 12/2006 |
| JP | 2007-165250 | A | 6/2007 |
| JP | 2009-283389 | A | 12/2009 |

OTHER PUBLICATIONS

Written Opinion (PCT/ISA/237) issued on Sep. 6, 2011, by the Japanese Patent Office as the International Searching Authority for International Application No. PCT/JP2011/063591.

Y. Iwata et al., "Performance of a Compact Injector for Heavy-Ion Medical Accelerators", Nuclear Instruments and Methods in Physics Research Section A, 572, Jan. 2, 2007, pp. 1007-1021.

K. Yamamoto et al., "Experimental Verification of an APF Linac for a Proton Therapy Facility", Nuclear Instruments and Methods in Physics Research B, 269, 2011, pp. 2875-2878.

* cited by examiner

DRIFT-TUBE LINEAR ACCELERATOR

TECHNICAL FIELD

The present invention relates to a drift-tube linear accelerator that accelerates charged particles with an electric field which is generated between electrodes (drift tube) supported by stems arranged in the cylindrical cavity by supplying radio frequency electric power to a cylindrical vacuum cavity.

BACKGROUND ART

A drift-tube linear accelerator is configured such that one or more pairs of hollow cylindrical drift-tube electrodes are arranged along the beam traveling direction in the cylindrical cavity. Radio-frequency electric power is fed into the cylindrical cavity and a radio-frequency electric field generated between the drift-tube electrodes accelerates charged particles (for example, such as protons or carbon ions) in the beam traveling direction. The drift-tube electrodes are designed to be arranged so that the charged particles exist inside the drift-tube electrodes when the radio-frequency electric field points toward the direction inverse to the beam traveling direction.

There are two types of electromagnetic field modes generated in the cylindrical cavity: TM mode (an electric field is generated in the longitudinal direction of the cylindrical cavity) and TE mode (a magnetic field is generated in the longitudinal direction of the cylindrical cavity). A drift-tube linear accelerator using the TM mode includes an Alvarez drift-tube linear accelerator. In this Alvarez drift-tube linear accelerator, since the electromagnetic field mode in the cylindrical cavity is used intact for an accelerating and focusing electric field to be generated between the drift-tube electrodes, the drift-tube electrodes are supported suspendedly from the cylindrical cavity. On the other hand, a drift-tube linear accelerator using the TE mode includes an interdigital H-mode (IH) drift-tube linear accelerator and the like. In the IH drift-tube linear accelerator, since the electromagnetic field mode in the cylindrical cavity cannot be used intact for an accelerating and focusing electric field to be generated between the drift-tube electrodes, the drift-tube electrodes is supported by stems that are alternately arranged vertically (or horizontally) in the cylindrical cavity, to generate indirectly an accelerating and focusing electric field between the drift-tube electrodes by an induced current.

When radio-frequency power of a predetermined frequency is introduced into the cavity, a resonance occurs and an electric field is generated between the drift-tube electrodes. By the electric field generated between the drift-tube electrodes, particles are accelerated increasingly every time passing through the drift-tube electrode.

Since a particle beam is aggregation of charged particles, a repulsive force acts between each other of the particles (this refers to as "space charge effect"). For that reason, the particles spread in both radial and traveling directions as they travel in the traveling direction; in particular, the radial spread causes loss of the particles due to collision with the vacuum duct wall. Hence, there is needed a beam radially focusing device that suppresses radial spreading of the beam. Conventionally, the beam spreading has been suppressed using a focusing device built-in drift-tube electrode that incorporates a focusing device and a drift-tube electrode (Patent Document 1). However, the alternating phase focusing (APF) method is recently proposed, in which a beam focusing force is obtained by a design that couples generation of curved electric-field distribution between drift-tube electrodes and the timing for charged particles to travel therebetween (Patent Document 2).

An APF-IH linear accelerator, which is fabricated by applying the APF method to an IH linear accelerator, eliminates the need for using such a focusing device built-in drift-tube electrode, achieving low cost and simple structure; and hence has been used, for example, in a field such as of medical devices necessary for reliability.

In a medical synchrotron facility using a heavy particle beam such as of carbon ions (not include protons), an APF-IH linear accelerator is utilized as a subsequent stage accelerator to the injector. Carbon ions produced by an ion source are pre-accelerated through a former stage accelerator, and then focused by three successive quadrupole electromagnets so as to satisfy an injection condition (acceptance) of the APF-IH linear accelerator. After that, the injected tetravalent carbon beam of 400 eμA (=100 μA) is accelerated up to 4 MeV/u. By employing the APF-IH linear accelerator, compactness of about ⅙ in total length is achieved compared to a conventional drift-tube linear accelerator (Alvarez drift-tube linear accelerator) that uses a focusing device built-in drift-tube electrode (Non-Patent Document 1).

PRIOR ART DOCUMENT

Patent Document

Patent Document 1: JP H11-329795 A
Patent Document 2: JP 2006-351233 A

Non-Patent Document

Non-Patent Document 1: Nuclear Instruments and Methods in Physics Research A572 (2007), 1007-1021

SUMMARY OF THE INVENTION

Problem that the Invention is to Solve

Since a particle beam is aggregation of charged particles, a repulsive force due to their individual charges acts between each other of the particles. This space charge effect poses a problem that spreading force in the radial direction becomes dominant relative to that in the beam traveling direction, in particular for cases with a large current particle beam of light weight charged particles like protons and further with a low energy particle beam. Although an APF-IH linear accelerator particularly demonstrated a track record of accelerating a small current (100 μA) carbon beam up to 4 MeV/u, it was not able to accelerate, because of its weak focusing force, a large current proton beam of over 10 mA up to 7 MeV/u that is required for the injector of a medical synchrotron facility utilizing a proton beam. For example, a three times larger focusing force is required for focusing a proton beam than for a tetravalent carbon beam and further required is a 100 times larger current from 100 μA to over 10 mA, that is, a more than 300 times larger focusing force is required compared to the carbon beam. Therefore, it is hard to apply an APF-IH linear accelerator to acceleration of a large current proton beam.

The present invention is made to resolve the above problem with a conventional accelerator, and aimed at obtaining a drift-tube linear accelerator capable of accelerating a particle beam of large current.

Means for Solving the Problem

A drift-tube accelerator according to the present invention passes an injected particle beam through inside a plurality of cylindrical drift-tube electrodes arranged in a cylindrical cavity in a beam traveling direction of the particle beam and accelerates the particle beam by a radio-frequency electric field generated between the plurality of cylindrical drift-tube electrodes, wherein at least part of a focusing device for focusing the particle beam is disposed inside an end drift-tube electrode that is arranged nearest the injection side of the cylindrical cavity among the plurality of cylindrical drift-tube electrodes, with the focusing device being positionally adjustable independently of the end drift-tube electrode.

Advantages of the Invention

According to the present invention, a drift-tube linear accelerator can be provided that is capable of accelerating a particle beam of large current.

DETAILED DESCRIPTION OF EXEMPLARY EMBODIMENT OF THE INVENTION

Embodiment 1

Figure 1:
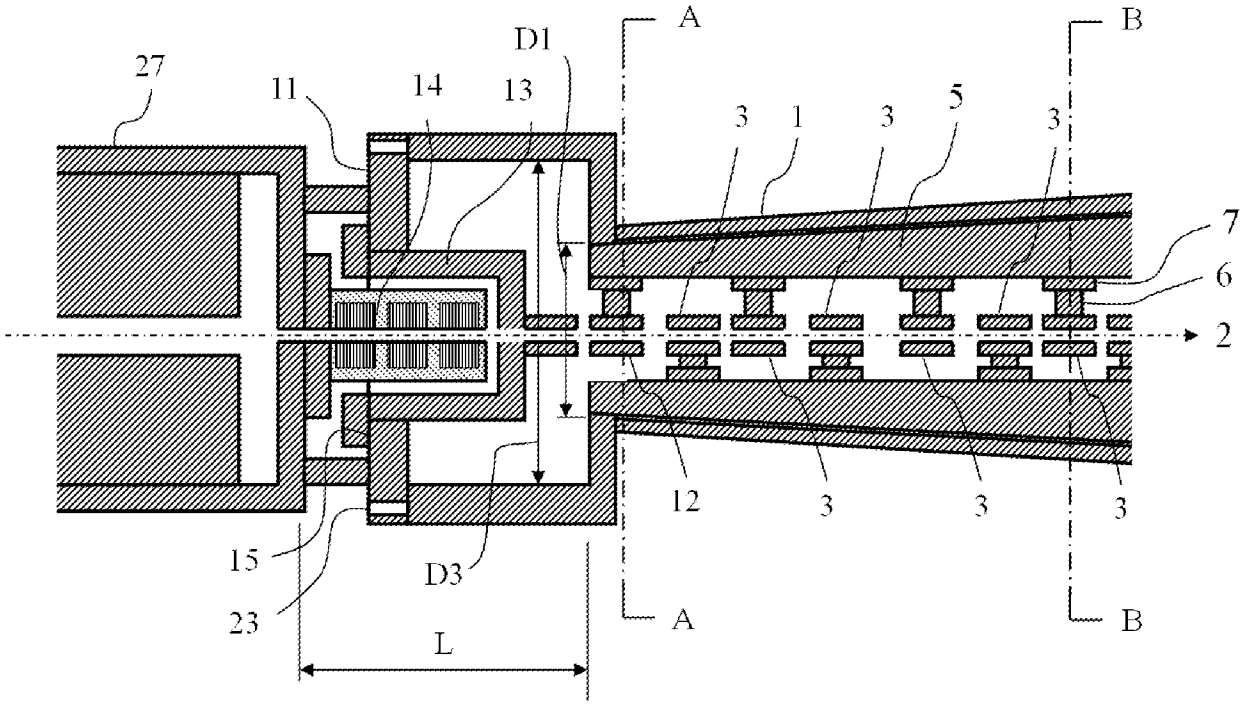
FIG. 1 is a schematic cross-sectional view showing a main part of a drift-tube linear accelerator according to Embodiment 1 of the present invention.

FIG. 1 is a cross-sectional view showing the main portion structure of a drift-tube linear accelerator according to Embodiment 1 of the present invention. The drift-tube linear accelerator of FIG. 1 is an APF-IH linear accelerator. In a cylindrical cavity 1 that also serves as a vacuum container, a plurality of first, second, . . . , and n-th drift-tube electrodes 3 are arranged along the beam traveling direction 2 from the injection side. Among the drift-tube electrodes, the first drift-tube electrode is designated at 12, and a drift-tube electrode adjacent to the first electrode 12 and next to the injection side, i.e., a drift-tube electrode that is arranged nearest the injection side is referred to as end drift-tube electrode and designated at 13. Since the APF focusing method is applied to the drift-tube linear accelerator, the gaps between the drift-tube electrodes 3 are characterized as being spaced not evenly but periodically. A pair of ridges 5 are disposed vertically (or horizontally) inside the cylindrical cavity 1. The drift-tube electrodes 3 are supported by stems 6 so as to be arranged on the ridges 5 disposed inside the cylindrical cavity 1. Note that the extraction-side cross section of the cylindrical cavity 1 is omitted in FIG. 1.

Figure 2:
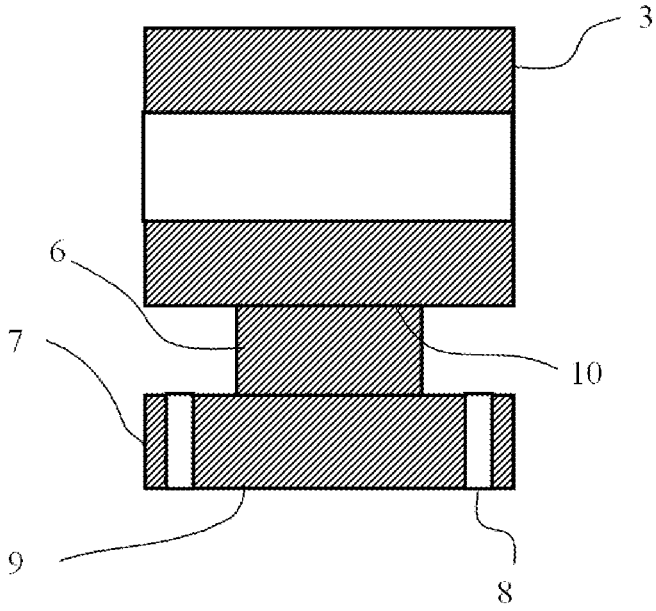
FIG. 2 is an enlarged cross-sectional view showing a drift-tube electrode of the drift-tube linear accelerator according to Embodiment 1 of the present invention.

FIG. 2 is an enlarged cross-sectional view of the drift-tube electrode 3. To generate a high-accuracy accelerating and focusing electric field distribution, the stems 6 need a positional adjustment for alignment to the extent of ±0.2 mm in the beam traveling direction and ±0.2 mm in the radial direction. Consequently, a positional adjustment mechanism is provided in the beam traveling direction and a finishing allowance is provided in the radial direction. As the positional adjustment mechanism for the beam traveling direction, it is convenient to take a technique in which a stem base 7 is provide to the stem 6 and the adjustment is made using holes 8 for screwing the stem base. As the finishing allowance for the radial direction, a bottom plane 9 of the stem base 7 (plane to be surface-contact with the ridge 5) is served, or a plane 10 for joining the drift-tube electrode 3 to the stem 6 is served when the drift-tube electrode 3 and the stem 6 are separable. FIG. 2 shows a case of the stem base 7 serving as the finishing allowance.

The hollow diameter (inner diameter) of the cylindrical cavity 1 increases toward the particle beam traveling direction 2. This is for preventing the intensity distribution of electric field generated between the drift-tube electrodes in the cylindrical cavity 1 from concentrating toward the injection side because a denser arrangement of the drift-tube electrodes toward the injection side is equivalent to concentration of electrostatic capacity toward the injection side in light of the cylindrical cavity 1 as a whole.

The intensity of electric field generated between the drift-tube electrodes follows Faraday's law expressed by the following Formula 1.

Formula 1

$$\int E_{DT} dl = -\oint \dot{B} dS \quad (1)$$

Figure 3:
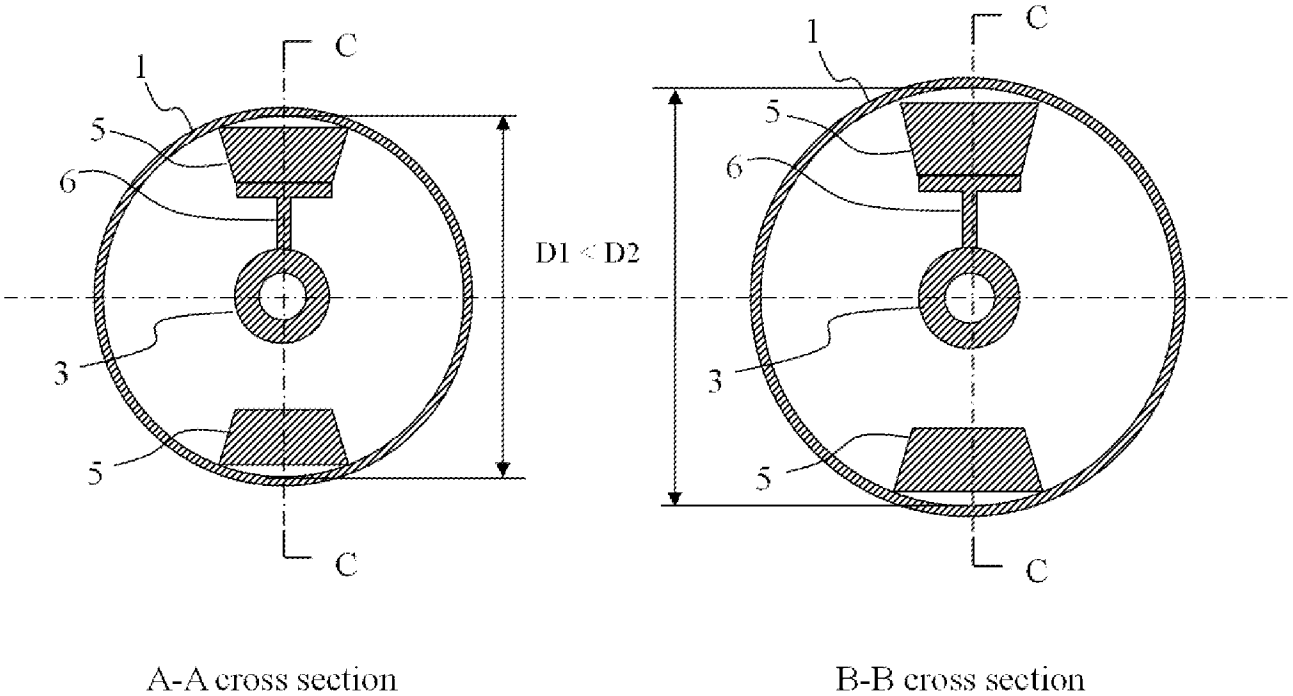
FIG. 3 is a schematic cross-sectional view showing cross sections at A-A and B-B positions in FIG. 1, of the drift-tube linear accelerator according to Embodiment 1 of the present invention.

Here, l represents a length between the drift-tube electrodes 3; $E_{DT}$, the intensity of electric field generated between the drift-tube electrodes 3; B, the intensity of magnetic field generated in the APF-IH linear accelerator; "•", a time derivative; and S, a cross section area enclosed by a RF current path (∝ the diameter the cylindrical cavity 1). According to the above formula, in order to intensify the electric field between the drift-tube electrodes 3, the cylindrical cavity 1 is made to have an increasing diameter. This diameter increase is illustrated in FIG. 3. FIG. 3 shows a cross-sectional view at A-A position in FIG. 1 (left hand side of FIG. 3) and a cross-sectional view at B-B position in FIG. 1. Conversely, the cross-sectional view at C-C position in FIG. 3 is FIG. 1. As shown in FIG. 3, the cylindrical cavity 1 is made such that its extraction-side diameter D2 is larger than its injection-side diameter D1. Increasing in this way the diameter of the cylindrical cavity 1 toward the extraction side enables the intensity distribution of electric field likely to concentrate in the injection side to expand toward the extraction side, obtaining as a result a uniform intensity distribution of electric-field all over the cylindrical cavity 1.

A particle beam is injected into the cylindrical cavity 1 from a pre-accelerator 27 such as, for example, a RFQ linear accelerator through three successive quadrupole permanent magnets 14, that is, a focusing device. The cylindrical cavity 1 is provided with end plates 11 at its both ends (the extraction-side end plate is not shown in FIG. 1). The end plates 11 are for forming the cylindrical cavity 1, or are needed for forming a vacuum container when the cylindrical cavity 1 also serves as the vacuum container. The end drift-tube electrode 13, which is paired with the first drift-tube electrode 12, is attached to the end plate 11. In particular, inside the injection side of the end drift-tube electrode 13, part of the three successive quadrupole permanent magnets 14 is disposed as the focusing device. While an example of disposing part of the focusing device is described in Embodiment 1, the whole focusing device may be disposed inside the end drift-tube electrode 13. In effect, advantage of the present invention is brought about with the configuration of disposing at least part of the focusing device inside the end drift-tube electrode 13.

Figure 4:
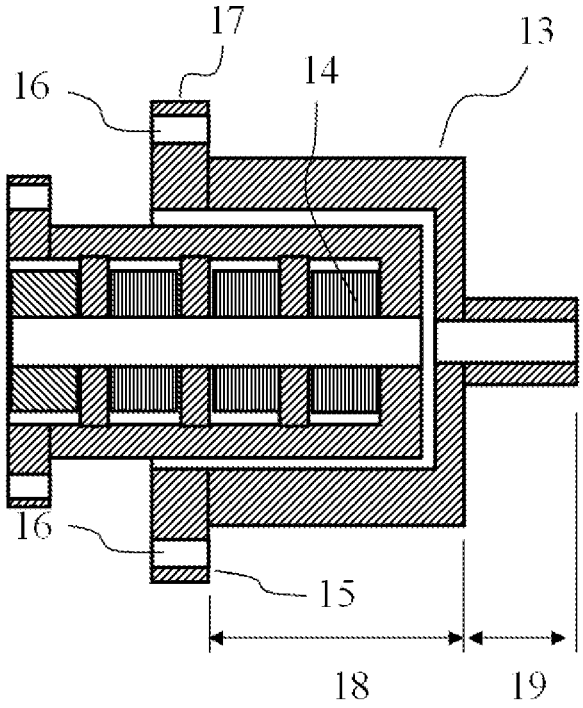
FIG. 4 is enlarged cross-sectional view showing an example of an end drift-tube electrode of the drift-tube linear accelerator according to Embodiment 1 of the present invention.

FIG. 4 is a detailed cross-sectional view of the end drift-tube electrode 13. The end drift-tube electrode 13 also needs a positional adjustment for alignment to the extent of ±0.2 mm in the beam traveling direction and ±0.2 mm in the radial direction with respect to the other drift-tube electrodes 3. Consequently, a finishing allowance is provided in the beam traveling direction and a positional adjustment mechanism is provided in the radial direction. For example, a plane 15 for joining the end plate 11 that is an end drift-tube electrode base 17 serves as a finishing allowance for the beam traveling direction, and holes 16 for screwing the end drift-tube electrode base for joining the end plane 11 serve as a radially positional adjusting mechanism. Otherwise, when the end plate 11 and the end drift-tube electrode 13 are joined by fitting, the radially positional adjustment is performed by holes 23 for screw which joins the end plate 11 to the cylindrical cavity 1 as shown in FIG. 1.

In order to generate an accelerating and focusing electric-field distribution between the end drift-tube electrode 13 and the first drift-tube electrode 12, the end drift-tube electrode 13 is made up of a first portion 18 that is radially enlarged to dispose the focusing device thereinside and a second portion 19 that has the same outer diameter as the other drift-tube electrodes 3. The length of the second portion 19 is designed so as to cause substantially no effects on the intensity of electric field generated between the end drift-tube electrode 13 and the first drift-tube electrode 12. For example, when no second portion is provided at all, electric lines of force generated between the first drift-tube electrode 12 and the end drift-tube electrode 13 differ obviously from those generated between the other drift-tube electrodes. For that reason, taking the position of the stem that supports the first drift-tube electrode 12 where the particles have a lowest energy as a reference, the second portion should be provided to have a length longer than the distance from the end plane of the first drift-tube electrode 12 facing the end drift-tube electrode 13 to the stem supporting the first drift-tube electrode 12. When there is a drift-tube electrode that has a length shorter than the entire length of the first drift-tube electrode, the shorter length is employed as the reference for applying the APF method.

The quadrupole permanent magnet 14 has north poles and south poles arranged alternately every 90 degrees. Since a magnetic field distribution generated by this magnet arrangement has an effect of focusing or spreading the beam horizontally and vertically, a three-successive arrangement, for example, spreading-focusing-spreading in the horizontal direction is employed.

Figure 5:
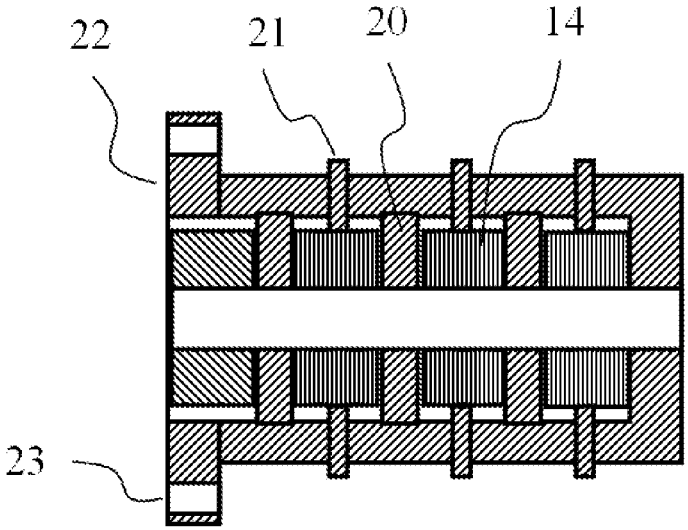
FIG. 5 is an enlarged cross-sectional view showing an example of a housing for a focusing device of the drift-tube linear accelerator according to Embodiment 1 of the present invention.

FIG. 5 is a detailed cross-sectional view showing an example of a housing for disposing the three successive quadrupole permanent magnets 14 as the focusing device. The three successive quadrupole permanent magnets 14 each need to be adjusted in the radial and the beam traveling directions to the extent of ±0.01 mm; hence there is provided a position adjustment mechanism that is capable of ensuring positional adjustment of each quadrupole permanent magnet 14 with respect to the housing. The positional adjustment in the beam traveling direction is made by machining spacers 20 or preparing plural spacers 20 of different thickness and picking up one of them. The positional adjustment in the radial direction is made by set screws 21 with respect to the inner diameter of the housing. Apart from the mechanism for ensuring coincidence of the structural center of the housing and the magnetic center of each quadrupole permanent magnet 14, there is provided a mechanism that is capable of ensuring radially positional adjustment between the structural center of the housing and the center of the beam axis. This positional adjustment mechanism is capable of ensuring a positional adjustment independently of the end drift-tube electrode 13. A plane 22 for connecting a structure (for example, the vacuum container of the pre-accelerator 27) that is arranged upstream from the APF-IH linear accelerator is utilized as a finishing allowance for the beam traveling direction, and holes 23 for screwing the upstream structure is use for adjustment in the radial direction. Incorporating into the housing a current measuring instrument, such as current transformer, together with the focusing device allows for measuring the amount of the particle beam current injected into the APF-IH linear accelerator. In addition, when an auto-adjusting mechanism is provided to the housing, these adjustments can be made even during a beam test that is carried out under a vacuum condition.

A high current proton beam of over 10 mA is injected as a particle beam into the APF-IH linear accelerator from the injection side. The injected particle beam is not always aligned with the center axis of the three successive quadrupole permanents magnets 14. When an injected particle beam that is out of axis with respect to the center of the quadrupole magnets passes therethrough, a deflecting action is produced on the beam itself, in addition to the focusing and spreading action in the radial direction. In particular, since a magnetic field gradient generated by a quadrupole magnet for focusing a large current proton beam is of 100 T/m level, the deflection amount cannot be neglected. Accordingly, a positional adjustment within about ±0.1 mm is needed for the beam axis to be aligned with the center of the quadrupole magnets.

Figure 6:
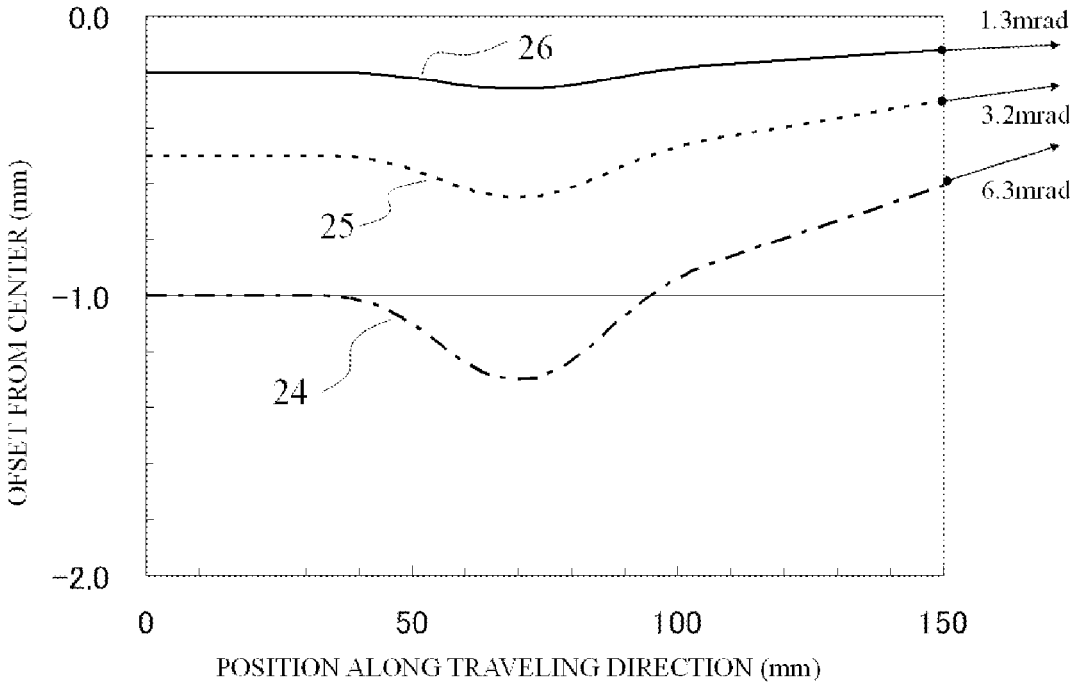
FIG. 6 is a graph for explaining an effect of positional displacement of a particle beam injected into the drift-tube linear accelerator.

FIG. 6 shows a deflection amount (dot-dash curved line 24) of a particle beam injected with an offset of 1 mm in a direction perpendicular to the sheet of FIG. 1 from the center with respect to the three successive permanent magnets generating a 100 T/m-level magnetic-field gradient (spreading-focusing-spreading in the direction perpendicular to the sheet of FIG. 1); a deflection amount (broken curved line 25) of a particle beam injected with an offset of 0.5 mm; and a deflection amount (solid curved line 26) of a particle beam injected with an offset of 0.2 mm. Since APF-IH linear accelerators generate weak focusing force in the radial direction, a tolerance value for the beam angle error is as small as 1 mrad. The deflection amount of the injected particle beam offset by 0.2 mm is about 1.3 mrad (which is the tangent of the solid curved line 26 at its right end; the evaluated tangent value of each curved line is shown in FIG. 6 together with the arrow indicative of the tangent). This reveals that even offset of 0.2 mm is not negligible. For that reason, the position of the injected particle beam is measured, and the deflection amount of the beam is also measured when the three successive quadrupole permanent magnets 14 are disposed, whereby the position of the quadrupole permanent magnets 14 is adjusted so that the beam falls within the beam angle tolerance.

Since the drift-tube linear accelerator accelerates the particle beam by the RF electric field between the drift-tube electrodes 3, no acceleration can be produced during the period when the generated RF electric field is inverse to the beam traveling direction. Hence, arrangement of the drift-tube electrodes 3 is designed so that the particle beam exists inside the drift-tube electrodes 3 during this period so as not to be affected by the RF electric field inverse to the beam traveling direction. Accordingly, even if a DC beam (temporally continuous beam) is injected into the drift-tube linear accelerator, not all of the particles in the beam can be accelerated. For that reason, in order to extract a required amount of current from the drift-tube linear accelerator, for example a RFQ linear accelerator is used as the pre-accelerator 27 that is capable of accelerating and bunching the particle beam in a low energy region. In this case, a DC beam or a particle beam that is spread in the traveling direction needs to be injected into the drift-tube linear accelerator after bunched using a buncher or the like that is capable of only bunching the particle beam. However, for example, when a RFQ linear accelerator is employed as the pre-accelerator 27 and a conventional quadrupole electromagnet is used for satisfying the radial acceptance of the APF-IH linear accelerator, the particle beam travels longer distance due to the large electromagnet size and spreads in the beam traveling direction owing to space charge effect.

As a result, even though the particle beam can be injected into the APF-IH linear accelerator, it cannot fall within the acceptance in the beam traveling direction; hence a particle beam of large current cannot be accelerated. In addition, since the end drift-tube electrode 13 needs to have a length necessary for the traveling-direction magnetic field generated in the IH linear accelerator to extend to both ends of the cylindrical cavity 1, it is impossible to shorten the length of the end drift-tube electrode 13 on account of the beam spread. For that reason, the quadrupole permanent magnets 14 that are capable of shortening the focusing device in the beam traveling direction are used, and part of the quadrupole permanent magnets 14 is disposed as the focusing device inside the end drift-tube electrode 13. The region L in FIG. 1 is a matching section for injecting a proton beam into the APF-IH linear accelerator. As a result of using the quadrupole permanent magnets 14 having a total length of about 50 mm, the distance from the tail end electrode of the pre-accelerator 27 to the first drift-tube electrode 12 of the APF-IH linear accelerator is suppressed to a distance of about three cycles of the operation frequency of 200 MHz, whereby the particle beam can be injected into the APF-IH linear accelerator (within the acceptance in the beam traveling direction) before spreading in the beam traveling direction.

Disposing part of the quadrupole permanent magnets 14 inside the end drift-tube electrode 13 increases in the occupancy ratio of the end drift-tube electrode 13 in the cavity compared to that of the other drift-tube electrodes 3. Accordingly, in the structure of the cylindrical cavity 1 expanding from the injection side toward the extraction side, substantial RF magnetic field region generated in the injection side by the RF input is reduced, leading to decrease in the accelerating and focusing electric field. The decrease in accelerating and focusing electric field loses the ability of focusing a large current particle beam since space charge effect is remarkable in the low energy region. For that reason, the injection side of the cylindrical cavity 1 is enlarged more than the increasing cavity diameter toward the extraction side in order to even out the intensity of electric field. Namely, as shown in FIG. 1, the inner diameter D3 of the portion of the cylindrical cavity 1 in which portion the end drift-tube electrode 13 is arranged is made larger than the inner diameter D1 of the portion of the cylindrical cavity 1 in which portion the drift-tube electrodes 12 is arranged.

Figure 7:
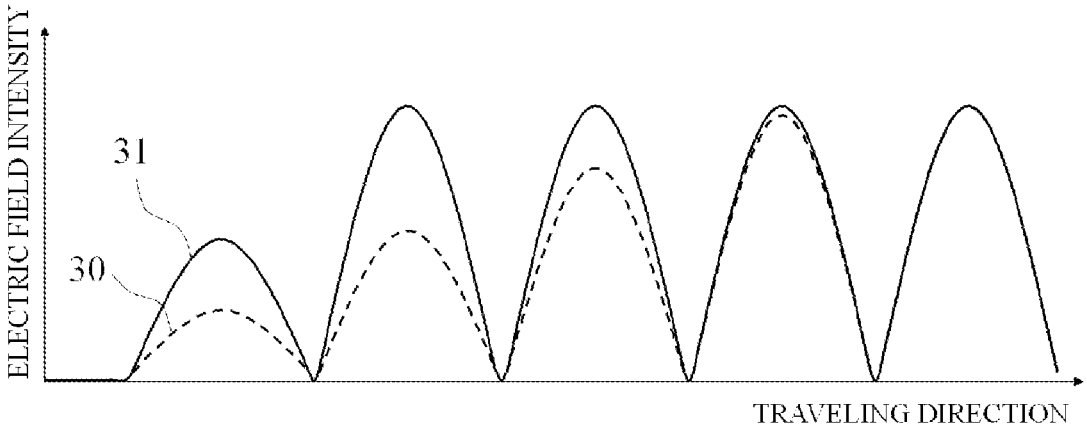
FIG. 7 is a graph for explaining an electric field distribution in the drift-tube linear accelerator according to Embodiment 1 of the present invention.

FIG. 7 is a graph showing variation of electric field distributions due to difference in the inner diameter D3 of the portion of the cylindrical cavity in which portion the end drift-tube electrode 13 is arranged. In FIG. 7, an electric field distribution 30 indicated by the dotted line is generated when the inner diameter D3 of the injection-side cylindrical cavity is not enlarged but is the same as the inner diameter D1 of the cylindrical cavity 1 near the first drift-tube electrode 12, and an electric field distribution 31 indicated by the solid line is generated when the inner diameter D3 of the portion of the cylindrical cavity in which portion the end drift-tube electrode 13 is arranged is enlarged more than D1 as shown in FIG. 1. Even if the focusing device is disposed inside the end drift-tube electrode 13, by enlarging the inner diameter of this portion of the cylindrical cavity 1 as shown in FIG. 7, a space region for generating the required magnetic field can be obtained in the portion of the cylindrical cavity 1 in which portion the end drift-tube electrode 13 is arranged, thereby intensifying the accelerating and focusing electric field in the injection side. Thus, enlarging the inner diameter of the portion of the cylindrical cavity in which portion the end drift-tube electrode 13 is arranged can deal with the diameter enlargement of the end drift-tube electrode 13 due to disposition of the focusing device therein.

The particle beam injected from the pre-accelerator or the like is not deflected but only focused by the gradient of strong magnetic field of the quadrupole permanent magnets 14, thereby to match with the radial injection condition of the APF-IH linear accelerator. Moreover, since the traveling distance between the pre-accelerator and the subsequent accelerator can be shortened, the particle beam also matches with the injection condition in the beam traveling direction. With regard to the accelerating and focusing electric field generated in the APF-IH linear accelerator, since the injection-side diameter of the cylindrical cavity 1 is enlarged, substantially the same electric field intensity as that generated between the other drift-tube electrodes can also be obtained between the end drift-tube electrode 13 and the first drift-tube electrode 12. Furthermore, since the shape of the portion of the end drift-tube electrode 13 opposite to the first drift-tube electrode 12 is the same as that of the first drift-tube electrode, an uneven electric field due to the disposition of the permanent magnets inside the end drift-tube electrode 13 can be suppressed. Still further, since the focusing device and the drift-tube electrode 13 are positionally adjusted independently of each other, the injection condition for the particle beam and the acceleration condition therefor can be independently satisfied, thereby accelerating a particle beam of large current.

REFERENCE CHARACTERS

1: cylindrical cavity
2: beam traveling direction
3: drift-tube electrodes
12: first drift-tube electrode
13: end drift-tube electrode
14: quadrupole permanent magnets (focusing device)
18: first portion of end drift-tube electrode
19: second portion of end drift-tube electrode
D1: cylindrical-cavity inner diameter near the first drift-tube electrode
D3: inner diameter of portion of the cylindrical cavity in which portion the end drift-tube electrode is arranged.

The invention claimed is:

1. A drift-tube linear accelerator that makes a particle beam injected from a pre-accelerator pass through inside a plurality of cylindrical drift-tube electrodes arranged in a cylindrical cavity of the linear accelerator in a traveling direction of the particle beam and accelerates the particle beam by a radio-frequency electric field generated between the plurality of cylindrical drift-tube electrodes, wherein at least part of a focusing device for focusing the particle beam is disposed between the pre-accelerator and an end drift-tube electrode that is arranged nearest the injection side of the cylindrical cavity among the plurality of cylindrical drift-tube electrodes and disposed inside the end drift-tube electrode, with the focusing device being positionally adjustable independently of the end drift-tube electrode.

2. The drift-tube linear accelerator of claim 1, wherein the end drift-tube electrode has a first portion and a second portion, the first portion being on the particle-beam injection side and inside the portion the focusing device being disposed, the second portion having an inner and an outer diameters smaller than the first portion and the outer diameter of the second portion being the same as that of a first drift-tube electrode arranged next to the end drift-tube electrode.

3. The drift-tube linear accelerator of claim 1, wherein the cylindrical cavity is a transverse-electric-mode cylindrical cavity whose inner diameter increases toward the beam traveling direction of the particle beam, and an inner diameter of a potion of the cylindrical cavity in which portion the end drift-tube electrode is arranged is made larger than an inner diameter of a portion of the cylindrical cavity in which portion a first drift-tube electrode is arranged next to the end drift-tube electrode.

4. The drift-tube linear accelerator of claim 1, wherein the focusing device includes a quadrupole permanent magnet.

5. The drift-tube linear accelerator of claim 1, wherein an arrangement of the plurality of cylindrical drift-tube electrodes is an interdigital H type to which an alternating-phase focusing method is applied.

* * * * *